US008918046B2

(12) United States Patent
Yamamoto

(10) Patent No.: US 8,918,046 B2
(45) Date of Patent: Dec. 23, 2014

(54) IMAGE-FORMING DEVICE

(75) Inventor: Tomoya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 208 days.

(21) Appl. No.: 12/959,491

(22) Filed: Dec. 3, 2010

(65) Prior Publication Data

US 2011/0236099 A1 Sep. 29, 2011

(30) Foreign Application Priority Data

Mar. 25, 2010 (JP) ..... 2010-070132

(51) Int. Cl.

| | |
|---|---|
| ***B65H 9/00*** | (2006.01) |
| ***B65H 5/38*** | (2006.01) |
| ***G03G 21/18*** | (2006.01) |
| ***G03G 15/00*** | (2006.01) |
| ***B65H 3/44*** | (2006.01) |
| ***B65H 5/06*** | (2006.01) |

(52) U.S. Cl.

CPC .... *G03G 21/1814* (2013.01); *B65H 2404/6111* (2013.01); *B65H 9/006* (2013.01); *B65H 5/38* (2013.01); *B65H 2402/441* (2013.01); *B65H 2405/324* (2013.01); *G03G 15/6558* (2013.01); *B65H 3/44* (2013.01); *B65H 5/062* (2013.01)

USPC ..... 399/395; 399/394; 399/388

(58) Field of Classification Search

CPC ..... G03G 15/6567; G03G 2215/00561; B65H 9/004

USPC ..... 399/395, 388, 394; 271/161

See application file for complete search history.

(56) References Cited

U.S. PATENT DOCUMENTS

| | | | | |
|---|---|---|---|---|
| 6,137,989 | A * | 10/2000 | Quesnel | 399/394 |
| 7,369,792 | B2 | 5/2008 | Shiraki | |
| 7,386,253 | B2 | 6/2008 | Ishii et al. | |

(Continued)

FOREIGN PATENT DOCUMENTS

| | | | |
|---|---|---|---|
| CN | 101013281 | A | 8/2007 |
| JP | SHO 63-067552 | U | 5/1988 |

(Continued)

OTHER PUBLICATIONS

Machine translation of JP 2005024759 published Jan. 27, 2005.*

(Continued)

*Primary Examiner* — Judy Nguyen
*Assistant Examiner* — Ruben Parco, Jr.
(74) *Attorney, Agent, or Firm* — Banner & Witcoff, Ltd.

(57) ABSTRACT

An image-forming device includes a casing, a conveying path, a pair of registration rollers, and a process cartridge. The conveying path is disposed in the casing to convey a recording sheet. The pair of registration rollers is disposed on the conveying path to regulate a leading edge of the recording sheet conveyed along the conveying path. The process cartridge is detachably mounted on the casing, and includes a developer accommodating unit, a photosensitive member, and an upstream guide part. The photosensitive member is disposed on the conveying path. The upstream guide part is disposed upstream of the pair of registration rollers on the conveying path to guide the recording sheet toward the pair of registration rollers in cooperation with the conveying path. The upstream guide part is formed with a concaved part that is concaved in a direction away from the conveying path.

8 Claims, 3 Drawing Sheets

(56) References Cited

U.S. PATENT DOCUMENTS

| | | | | |
|---|---|---|---|---|
| 7,412,188 | B2 | 8/2008 | Ishii et al. | |
| 7,450,882 | B2 | 11/2008 | Shiraki | |
| 7,522,859 | B2 | 4/2009 | Ishii et al. | |
| 7,565,092 | B2 | 7/2009 | Shiraki | |
| 7,574,153 | B2 | 8/2009 | Nakayama et al. | |
| 7,764,903 | B2 | 7/2010 | Ishikawa et al. | |
| 2002/0076250 | A1* | 6/2002 | Johnson et al. | 400/630 |
| 2002/0150407 | A1* | 10/2002 | Ishiwata | 399/195 |
| 2004/0247355 | A1* | 12/2004 | Eguchi | 399/391 |
| 2005/0191088 | A1 | 9/2005 | Nishimura | |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0029423 | A1 | 2/2006 | Shiraki | |
| 2006/0159481 | A1* | 7/2006 | Horiuchi | 399/88 |
| 2007/0110464 | A1 | 5/2007 | Nakayama et al. | |
| 2007/0147921 | A1* | 6/2007 | Chae | 399/401 |
| 2008/0232878 | A1* | 9/2008 | Sekine et al. | 399/395 |
| 2009/0060568 | A1 | 3/2009 | Ishikawa et al. | |
| 2009/0169248 | A1* | 7/2009 | Ishii et al. | 399/111 |
| 2009/0269113 | A1 | 10/2009 | Ogawa | |

FOREIGN PATENT DOCUMENTS

| | | | | | |
|---|---|---|---|---|---|
| JP | 05319615 | A | * | 12/1993 | B65H 5/06 |
| JP | 08-157107 | | | 6/1996 | |
| JP | HEI 11-165916 | A | | 6/1999 | |
| JP | 2005-024759 | A | | 1/2005 | |
| JP | 2006-184401 | A | | 7/2006 | |
| JP | 2009-058740 | A | | 3/2009 | |
| JP | 2009-263103 | | | 11/2009 | |

OTHER PUBLICATIONS

Machine translation of JP 11-165916 published Jun. 22, 1999.*

JP Office Action dtd Feb. 21, 2012, JP Appln. 2010-070132, English translation.

Extended EP Search Report dtd Jun. 6, 2012, EP Appln. 10015262.8-2216.

CN Office Action dtd Jun. 5, 2013, CN Appln. 201110081558.3, English translation.

The Second Office Action mailed Jan. 17, 2014, CN Appln. 201110081558.3, English Translation.

The Decision of Rejection for Chinese Application No. 201110081558.3 dated Jun. 20, 2014.

* cited by examiner

IMAGE-FORMING DEVICE

CROSS REFERENCE TO RELATED APPLICATION

This application claims priority from Japanese Patent Application No. 2010-070132 filed Mar. 25, 2010. The entire content of this application is incorporated herein by reference.

TECHNICAL FIELD

The present invention relates to an image-forming device provided with a pair of registration rollers.

BACKGROUND

Conventionally, an image-forming device provided with a guide member disposed upstream of a pair of registration rollers in the conveying direction, for example, disclosed in Japanese unexamined patent application publication No. HEI-8-157107 is well known. When a recording sheet conveyed from a feeding tray bows in a direction orthogonal to a surface of the recording sheet by contacting the pair of registration rollers, the guide member is elastically deformed to absorb the bowing of the recording sheet.

Specifically, the guide member includes an upstream guide, a downstream guide, and a coil spring. The upstream guide is an elastic thin plate whose free end is disposed at the downstream. The downstream guide is rotatably disposed upstream of the upstream guide, and is a rigid plate whose free end is disposed at the upstream. The coil spring constantly biases the downstream guide toward the recording sheet.

SUMMARY

However, the above technique requires a lot of parts for absorbing the bowing of the recording sheet upstream of the pair of registration rollers.

In view of the foregoing, it is an object of the invention to provide an image-forming device capable of absorbing the bowing of the recording sheet without increasing the number of the parts.

In order to attain the above and other objects, the invention provides an image-forming device including a casing, a conveying path, a pair of registration rollers, and a process cartridge. The conveying path is disposed in the casing to convey a recording sheet. The pair of registration rollers is disposed on the conveying path to regulate a leading edge of the recording sheet conveyed along the conveying path. The process cartridge is detachably mounted on the casing, and includes a developer accommodating unit, a photosensitive member, and an upstream guide part. The developer accommodating unit supplies a developer. The photosensitive member is disposed on the conveying path. A visible image is formed on the photosensitive member with the developer. The visible image is transferred onto the recording sheet whose leading edge is regulated by the pair of registration rollers. The upstream guide part is disposed upstream of the pair of registration rollers on the conveying path to guide the recording sheet toward the pair of registration rollers in cooperation with the conveying path. The upstream guide part is formed with a concaved part that is concaved in a direction away from the conveying path.

BRIEF DESCRIPTION OF THE DRAWINGS

The particular features and advantages of the invention as well as other objects will become apparent from the following description taken in connection with the accompanying drawings, in which.

DETAILED DESCRIPTION

A laser printer 1 according to a preferred embodiment of the image-forming device of the present invention will be described while referring to FIGS. 1 though 3. In the following description, the general structure of the laser printer 1 will be described firstly, and then, the unique part of the laser printer 1 will be described in detail.

In the following description, orientations will be referred to assuming that the laser printer 1 is disposed in an orientation in which it is intended to be used. More specifically, the right side, the left side, the near side, the far side, the top side, and the bottom side in FIG. 1 are called as the "front," "rear," "left," "right," "top," and "bottom," respectively. Further, the upstream and the downstream in a conveying direction of a recording sheet P will be just called as "upstream" and "downstream," respectively.

<General Construction of Laser Printer>

Figure 1:
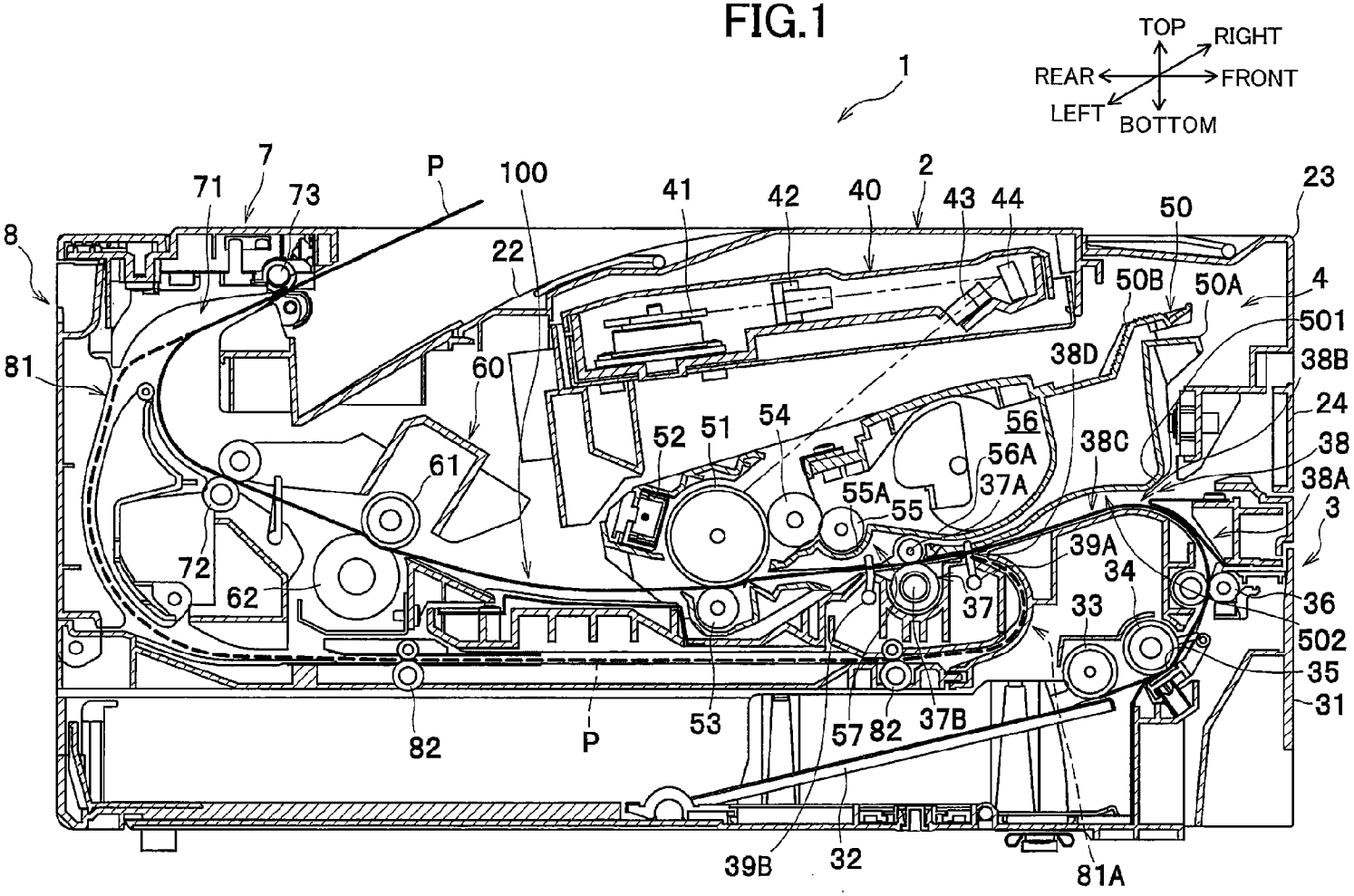
FIG. 1 is a cross-sectional view of a laser printer according to a preferred embodiment of an image-forming device according to the present invention.

As shown in FIG. 1, the laser printer 1 is a monochrome printer, and includes a casing 2, a feeding unit 3, an image-forming unit 4, a discharge unit 7, and a reversing unit 8 in order to form images on both sides of a recording sheet P. The feeding unit 3, the image-forming unit 4, the discharge unit 7, and the reversing unit 8 are accommodated in the casing 2.

Figure 3:
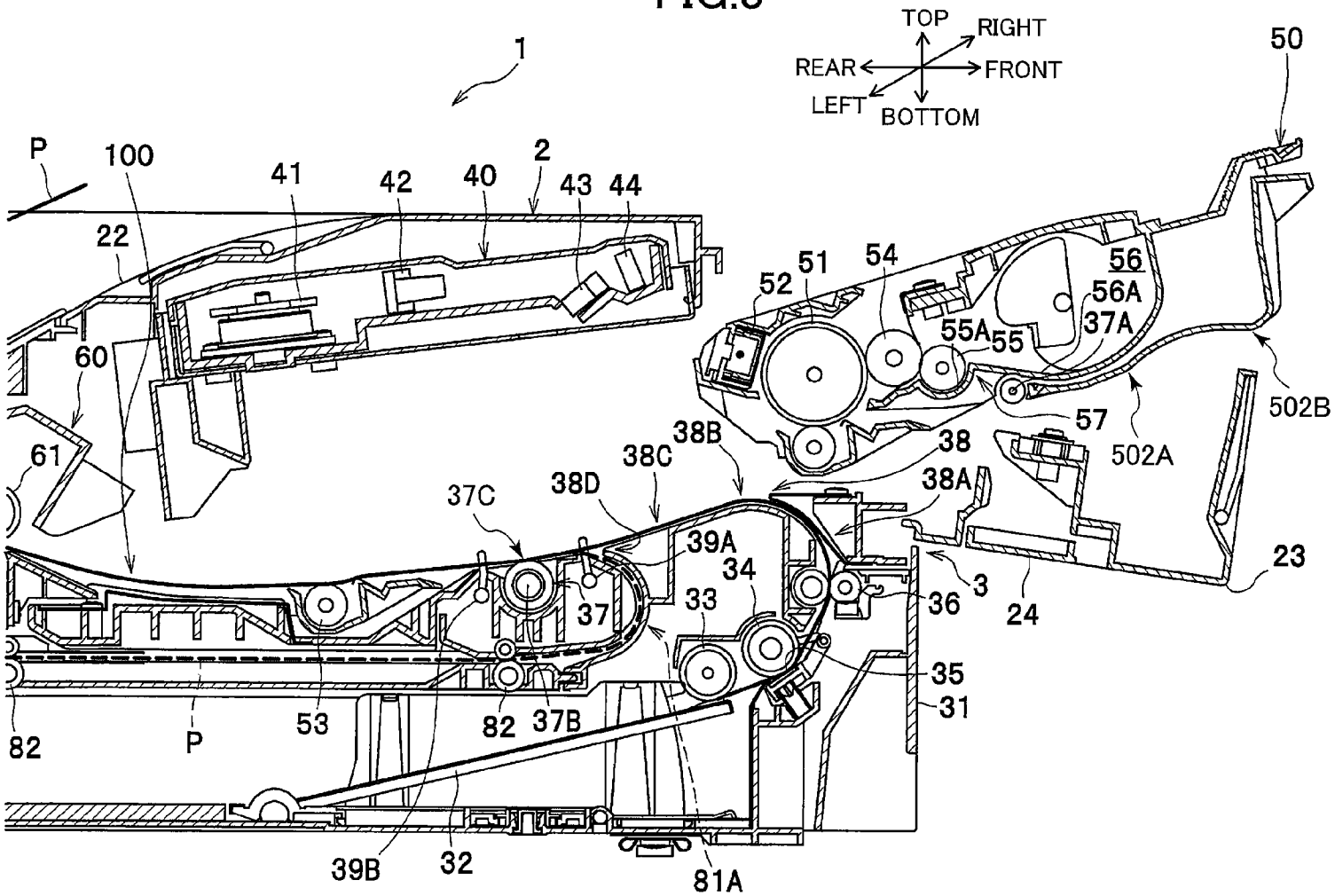
FIG. 3 is a cross-sectional view of the laser printer when a process cartridge is detached from a casing.

The casing 2 includes a front cover 23 that is opened when a process cartridge 50 described later is mounted on or detached from the casing 2 (FIG. 3). A manual feeding tray 24 on which recording sheets P for manual feeding are set is rotatably provided on the front cover 23

The feeding unit 3 is disposed at the lower section of the casing 2 to feed a recording sheet P to the image-forming unit 4. The feeding unit 3 mainly includes a feeding tray 31, a paper-pressing plate 32, a feeding roller 33, a separating roller 34, a separating pad 35, a pair of first conveying rollers 36, a pair of registration rollers 37, and a feeding path 38.

The feeding path 38 is a path for guiding the recording sheet P fed by the feeding roller 33 to the image-forming unit 4, specifically a position between a photosensitive drum 51 and a transfer roller 53. The feeding path 38 extends from the neighborhood of the feeding roller 33 toward the front-top side, and then, is curved to extend toward the position between the photosensitive drum 51 and the transfer roller 53. The pair of registration rollers 37 is disposed upstream of the photosensitive drum 51, and is controlled to rotate and stop in order to adjust the leading edge of the recording sheet P to be conveyed to the photosensitive drum 51. The feeding path 38 and the pair of registration rollers 37 will be described later in detail.

The recording sheets P accommodated in the feeding tray 31 detachable from the casing 2 are pressed toward the feeding roller 33 by the paper-pressing plate 32 to contact the feeding roller 33. A few recording sheets P are fed to the separating roller 34 by the feeding roller 33. The topmost recording sheet P among the recording sheets P fed by feeding roller 33 is separated from the other recording sheets P by the separating roller 34. The separated recording sheet P is conveyed to the image-forming unit 4 (the position between the photosensitive drum 51 and the transfers roller 53) along the feeding path 38 by the pair of first conveying rollers 36 and the pair of registration rollers 37.

The image-forming unit 4 is disposed above the feeding unit 3 (the feeding tray 31) to form an image on the conveyed recording sheet P. The image-forming unit 4 includes an exposing unit 40, the process cartridge 50, and a fixing unit 60.

The exposing unit 40 is disposed at the upper section of the casing 2, and includes a laser-emitting unit (not shown), a polygon mirror 41, lenses 42 and 43, and a reflecting mirror 44. The laser-emitting unit emits a laser beam corresponding to image data. As shown in the chain line in FIGS. 1 and 2, the laser beam is reflected at the polygon mirror 41, passes through the lens 42, is reflected at the reflecting mirror 44, and passes through the lens 43 to high-speed-scan the surface of the photosensitive drum 51.

The process cartridge 50 is disposed below the exposing unit 40. As shown in FIG. 3, the process cartridge 50 can be mounted on or detached from the casing 2 for replacement thorough an opening that appears when the front cover 23 is opened. The process cartridge 50 includes a photosensitive unit 50A and a developing unit 50B detachable from the photosensitive drum 50A.

The photosensitive unit 50A includes the photosensitive drum 51, a charger 52, and the transfer roller 53. The developing unit 50B includes a developing roller 54, a supply roller 55, and a toner accommodating unit 56. The process cartridge 50 will be described later in detail.

The fixing unit 60 is disposed at the rear of the process cartridge 50, and includes a heating roller 61 and a pressure roller 62 opposed to the heating roller 61 to contact the heating roller 55 with pressure.

The surface of the photosensitive drum 51 is uniformly charged by the charger 52, and is exposed by being high-speed-scanned by the laser beam emitted from the exposing unit 40, thereby an electrostatic latent image being formed on the surface of the photosensitive drum 51. On the other hands, toners (developers) accommodated in the toner accommodating unit 56 are carried on the developing roller 54 by the supply roller 55.

The toners carried on the developing roller 54 are supplied to the electrostatic latent image formed on the photosensitive drum 51, thereby the electrostatic latent image being developed to a toner image (a visible image) with the toner. In other words, the supply roller 55 supplies toners to the photosensitive drum 51 through the developing roller 54.

The toner image formed on the photosensitive drum 51 is transferred onto the recording sheet P when the recording sheet P is conveyed to the position between the photosensitive drum 51 and the transfer roller 53. The toner image transferred onto the recording sheet P is fixed to the recording sheet P by heat when the recording sheet P is conveyed to a position between the heating roller 61 and the pressure roller 62.

The discharge unit 7 includes a discharge path 71, a pair of second conveying rollers 72, and a pair of discharge rollers 73 in order to discharge the recording sheet P to which the toner image is fixed by heat outward of the casing 2.

The discharge path 71 is a curved path for guiding the recording sheet P conveyed from the image-forming unit 4 (the fixing unit 60) to the outside of the casing 2.

The pair of discharge rollers 73 is disposed near the end of the discharge path 71 and is rotated in a forward direction or a reverse direction by a conventional control method. Specifically, the pair of discharge rollers 73 discharges the recording sheet P when rotated in the forward direction, and conveys the recording sheet P to the reversing unit 8 when rotated in the reverse direction.

As shown in the solid line in FIG. 1, the recording sheet P discharged from the image-forming unit 4 is conveyed to the pair of discharge rollers 72 along the discharge path 71, while changing the conveyed direction from the rear-to-top direction to the front-to-top direction. When one side printing or both side printing for the recording sheet P has been terminated, the recording sheet P is discharged to the outside of the casing 2 by the pair of discharge rollers 73 that rotates in the forward direction, thereby the recording sheet P being put on the discharge tray 22.

On the other hand, when a printing is performed for the back side of the recording sheet P in the both side printing, the pair of discharge rollers 73 is rotated in the reverse direction before the recording sheet P is fully discharged to the outside of the casing 2. Thus, the recording sheet P is pulled into the casing 2 again to be conveyed to the image-forming unit 4 thorough the reversing unit 8 (a reversing path 81 (the dotted line in FIG. 1)).

<Construction of Reversing Unit>

In order to forming images on the other side of the recording sheet P, the reversing unit 8 reverses the recording sheet P having one side on which an image has been formed, and conveys the reversed recording sheet P to the image-forming unit 4. The reversing unit 8 includes the reversing path 81 and a pair of third conveying rollers 82.

The reversing path 81 is a path for guiding the recording sheet P having one side on which an image has been formed to the image-forming unit 4, again. The reversing path 81 will be described later in detail.

The recording sheet P having one side on which an image has been formed is conveyed to the reversing path 81 (the dotted line in FIG. 1) by the pair of discharge rollers 73, and then, is conveyed to the image-forming unit 4 thorough the reversing path 81 by the pair of third conveying rollers 82. After an image is formed on the other side of the recording sheet P by the image-forming unit 4, the recording sheet P is discharged to the outside of the casing 2 by the discharge unit 7, thereby the recording sheet P being put on the discharge tray 22.

<Construction around Conveying Path>

Next, a conveying path 100 that is the unique part of the laser printer 1 will be described in detail.

As shown in FIG. 1, the conveying path 100 has an S-shape that extends from the feeding tray 31 to the discharge tray 22, and includes the feeding path 38 and the discharge path 71 described above. The feeding path 38 has a first U-shaped part 38A that U-turns the recording sheet P conveyed from the feeding tray 31 from forward to rearward of the casing 2.

The feeding path 38 further has a topmost part 38B of the first U-shaped part 38A, and a falling slope part 38C. Since the falling slope part 38C diagonally goes down from the topmost part 38B to a nipping point 37C (FIG. 3) of the pair of registration rollers 37, a substantially triangle-shaped space is formed above the falling slope part 38C when viewed in the left-to-right direction. In the preferred embodiment, the process cartridge 50 is disposed in the substantially triangle-shaped space in order to downsize the laser printer 1 in the top-to-bottom direction.

The feeding path 38 further has a meeting point 38D at which the feeding path 38 meets the reversing path 81. As shown in FIG. 3, the heights of the topmost part 38B, the meeting point 38D, and the nipping point 37C gradually decrease in this order. With this construction, it becomes possible to make the R-shapes of the first U-shaped part 38A and a second U-shape part 81A described later larger. Therefore, it is possible to smoothly convey the recording sheet P fed from the feeding tray 31 and conveyed through the reversing path 81 to the nipping point 37C.

The process cartridge 50 (the photosensitive unit 50A) has a lower wall part 501 positioned upstream of the pair of registration rollers 37 when the process cartridge 50 is mounted on the casing 2. The lower wall part 50 is opposed to the falling slope part 38C in the top-to-bottom direction. The lower wall part 501 guides the recording sheet P conveyed by the pair of first conveying rollers 36 to the pair of registration rollers 37.

The lower wall part 501 is formed with a concaved part 502 that is concaved toward the top. When the recording sheet P bows by contacting the pair of registration rollers 37, the concaved part 502 absorbs the bowing of the recording sheet P.

The concaved part 502 can be shaved by the leading edge of the recording sheet P conveyed by the pair of first conveying rollers 36. However, the concaved part 502 is formed on the lower wall part 501 of the photosensitive unit 50A. Therefore, even if the concaved part 502 is shaved by the leading edge of the recording sheet P, a user has only to replace the photosensitive unit 50A without replacing the process cartridge 50 including both the photosensitive unit 50A and the developing unit 50B. Further, the developing unit 50B can be constructed so as to move close to and away from the photosensitive drum 51 in order to absorb the stir of the photosensitive drum 51. On the other hand, in the preferred embodiment, the photosensitive unit 50A on which the concaved part 502 is formed is supported by the casing 2. Therefore, even if the developing unit 50B moves, the concaved part 502 can remain stationary. Thus, the concaved part 502 can reliably absorb the bowing of the recording sheet P.

An empty space exists inside the process cartridge 50 and upstream of the center of the toner accommodating unit 56 having a hollow cylindrical shape (below the front wall of the toner accommodating unit 56). The concaved part 502 is disposed in the empty space in order to use the space effectively.

The pair of registration rollers 37 includes a registration roller 37A disposed above the feeding path 38 and a registration roller 37B disposed below the feeding path 38. The registration roller 37A is integrally rotatably disposed at the rear of the lower wall part 501 of the process cartridge 50. Therefore, when the process cartridge 50 is detached from the casing 2, only the registration roller 37A can be detached from the casing 2, remaining the registration roller 37B (see FIG. 3). With this construction, even if the recording sheet P is jammed around the pair of registration rollers 37, the jammed recording sheet P can be easily removed by detaching the process cartridge 50 from the casing 2.

The reversing path 81 is a path for reversing the recording sheet P conveyed to the discharge path 71 positioned downstream of the photosensitive drum 51, toward the upstream of the pair of registration rollers 37. The reversing path 81 meets the feeding path 38 at the falling slope part 38C. Specifically, the reversing path 81 meets the falling slope part 38C at the meeting point 38D positioned upstream of the pair of registration rollers 37 and downstream of the concaved part 502 in the feeding path 38.

With this construction, the conveying distance (the length of the reversing path 81) is shortened as compared with a case in which the reversing path 81 meets the falling slope part 38C at a position facing the concaved part 502. Further, the recording sheet P fed from the feeding tray 31 goes from a space formed between the falling slope part 38C and the concaved part 502 toward a space formed between the falling slope part 38C and a part of the lower wall part 501 disposed downstream of the concaved part 502. Since the latter space has a width narrower than the former space in the top-to-bottom direction. Therefore, the recording sheet P can stably enter between the pair of registration rollers 37 through the latter space.

The reversing path 81 has the second U-shape part 81A for U-turning the recording sheet P at a just outside of the meeting point 38D of the reversing path 81 with the feeding path 38. The radius of the first U-shaped part 38A is greater than the radius of the second U-shape part 81A. With this construction, when one side printing is performed for a recording sheet P having a greater thickness than a plain paper, such as a post card or a cardboard, it becomes possible to smoothly convey the recording sheet P accommodated in the feeding tray 31 thorough the first U-shaped part 38A.

Figure 2:
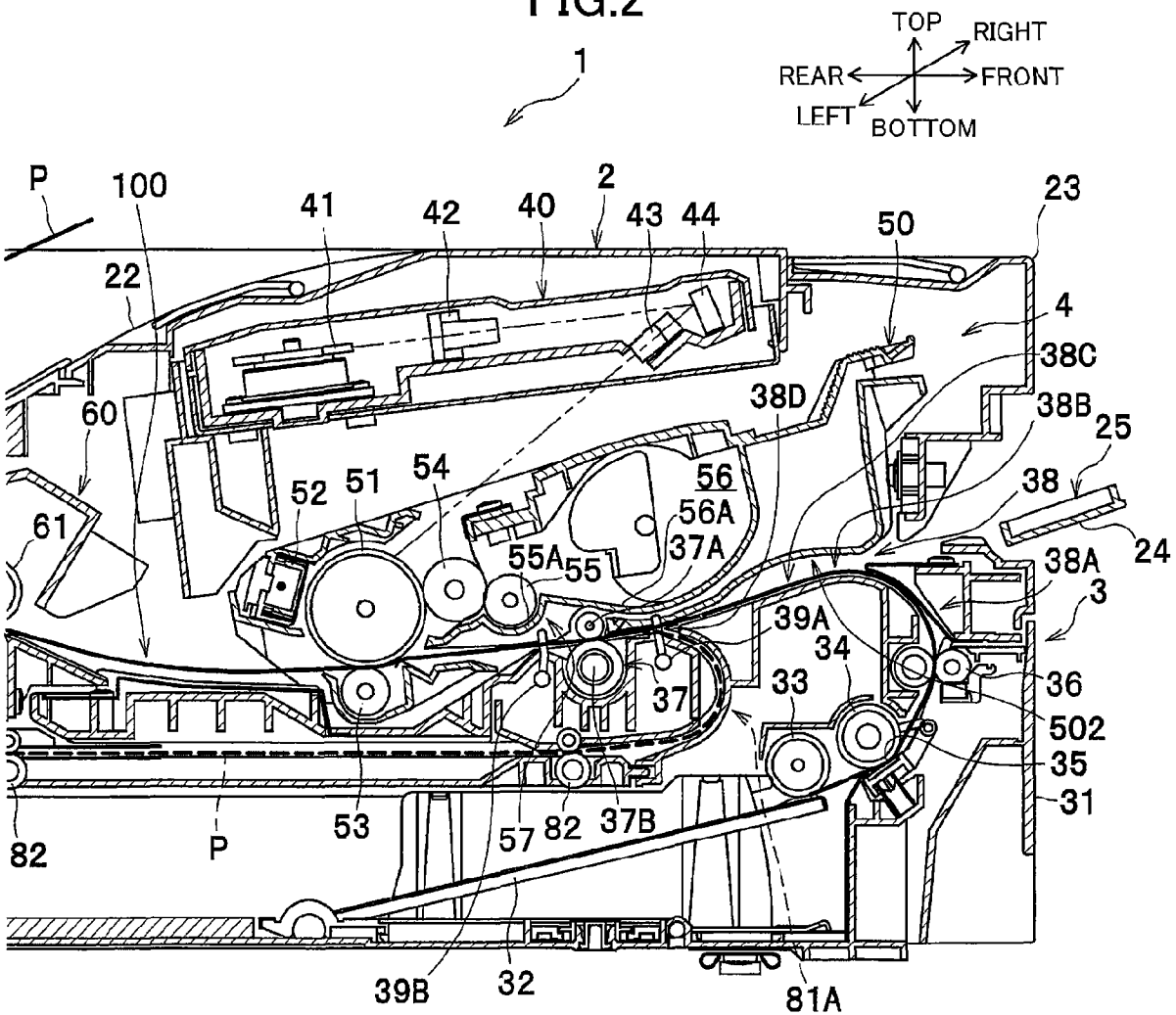
FIG. 2 a cross-sectional view of the laser printer when a manual feeding tray is opened.

As shown in FIG. 2, when the manual feeding tray 24 is opened, the top surface of the manual feeding tray 24 constitutes a portion of a manual feeding path 25. The manual feeding path 25 arbitrarily includes a feeding roller etc. in order to feed the recording sheet P for manual feeding to the topmost part 38B of the first U-turn shape part 38A.

The manual feeding path 25 is constructed so as to become parallel to the falling slope part 38C (specifically, the extended line of the falling slope part 38C). With this construction, it becomes possible to smoothly convey the recording sheet P for manual feeding from the manual feeding path 25 to the falling slope part 38C.

Further, the manual feeding path 25 is constructed so as to become parallel to a line connecting a first end 502A and a second end 502B (FIG. 3) defining the concaved part 502 when viewed in the left-to-right direction (a width direction of the conveying path 100). With this construction, the recording sheet P conveyed from the manual feeding path 25 is restrained from bowing due to the contact with the inside surface of the concaved part 502.

As described above, in the preferred embodiment, the concaved part 502 formed on the process cartridge 50 absorbs the bowing of the recording sheet P. Therefore, a lot of parts are not required for absorbing the bowing of the recording sheet.

Further, in the preferred embodiment, the concaved part 502 is formed on the photosensitive unit 50A. Therefore, even if the concaved part 502 is shaved by the leading edge of the recording sheet P, a user has only to replace the photosensitive unit 50A without replacing the process cartridge 50 including both the photosensitive unit 50A and the developing unit 50B. In other words, it is not required to replace the developing unit 50B that remains usable. Further, since the concaved part 502 is formed on the photosensitive unit 50A supported by the casing 2, the concaved part 502 does not move. Therefore, it becomes possible to reliably absorb the bowing of the recording sheet P, even when the developing unit 50B is constructed so as to move with respect to the photosensitive drum 51.

Further, in the preferred embodiment, the concaved part 502 is disposed at the empty space existing at the upstream of the toner accommodating unit 56. Therefore, it becomes possible to effectively use the empty space.

Further, in the preferred embodiment, the manual feeding path 25 is constructed so as to become parallel to a line connecting the both ends of the concaved part 502. Therefore, the recording sheet P conveyed from the manual feeding path 25 is restrained from bowing due to the contact with the inside surface of the concaved part 502.

Further, in the preferred embodiment, the reversing path 81 meets the falling slope part 38C at the meeting point 38D positioned downstream of the concaved part 502 in the feeding path 38. Therefore, the conveying distance (the length of the reversing path 81) can be shortened. Further, the recording sheet P fed from the feeding tray 31 goes toward a narrower space formed downstream of the concaved part 502. Therefore, it becomes possible to stabilize the conveyance of the recording sheet P to the pair of registration rollers 37.

Further, in the preferred embodiment, the process cartridge 50 is disposed in the substantially triangle-shaped space formed above the falling slope part 38C when viewed in the left-to-right direction. Therefore, it becomes possible to downsize the laser printer 1 in the top-to-bottom direction.

While the invention has been described in detail with reference to the preferred embodiment thereof, it would be apparent to those skilled in the art that various changes and modifications may be made therein without departing from the spirit of the invention.

For example, in the preferred embodiment, the concaved part 502 is formed on the lower part wall 501 of the process cartridge 50. However, the concaved part 502 may not be formed on the process cartridge 50. For example, the casing 2 may include a protruding part that protrudes from the casing 2, and the concaved part 502 may be formed on the protruding part.

Further, in the preferred embodiment, the photosensitive drum 51 is adopted as the photosensitive member. However, a belt-like photosensitive member may be adopted as the photosensitive member, for example. Further, in the preferred embodiment, the normal paper, the post card, and the cardboard are adopted as the recording sheet. However, an OHP sheet may be adopted as the recording sheet, for example.

Further, in the preferred embodiment, the feeding tray 31 detachable from the casing 2 is adopted as the sheet accommodating unit. However, a recessed member integrally formed in the casing 2 is adopted as the sheet accommodating unit. Further, in the preferred embodiment, the laser printer 1 that performs a monochrome printing is adopted as the image-forming device. However, a color printer may be used as the image-forming device. Further, a duplicate machine or an all-in-one printer may be used as the image-forming device.

Further, in the preferred embodiment, the manual feeding tray 24 is used as one part of the manual feeding path 25. However, the manual feeding tray 24 may not be necessarily provided. For example, a path extending from an opening formed on the wall of the casing 2 to the feeding path 38 may used as the manual feeding path.

What is claimed is:

1. An image-forming device comprising:

a casing;

a conveying path disposed in the casing and along which a recording sheet is conveyed in a conveying direction, the conveying path including:

a U-shaped part having a topmost part; and a downward part extending diagonally downwardly from the topmost part of the U-shaped part, the recording sheet being conveyed along the U-shaped part and the downward part in this order, the recording sheet being conveyed diagonally downwardly on the downward part;

a pair of registration rollers disposed on the conveying path to regulate a leading edge of the recording sheet conveyed along the conveying path; and a process cartridge detachably mounted in the casing, the process cartridge including:

a developer accommodating unit configured to contain developer, the developer accommodating unit including a convex part, the convex part protruding toward the downward part, the convex part having:

a lowermost part disposed most adjacent to the downward part of the conveying path, the lowermost part disposed upstream of the pair of registration rollers in the conveying direction; and an upstream end part disposed upstream of the lowermost part in the conveying direction; and an upstream guide part disposed upstream of the pair of registration rollers in the conveying direction, the upstream guide part facing the downward part of the conveying path, the upstream guide part being configured to guide the recording sheet toward the pair of registration rollers in cooperation with the downward part of the conveying path, and the upstream guide part including:

a concaved part being concaved in an upward direction away from the downward part of the conveying path, the concaved part extending in the conveying direction from a first end disposed upstream of the topmost part of the U-shaped part of the conveying path in the conveying direction to a second end disposed between the upstream end part of the convex part of the developer accommodating unit and the lowermost part of the convex part of the developer accommodating unit in the conveying direction; and a parallel part disposed in the conveying path between the concaved part and the pair of registration rollers and disposed below the lowermost part of the convex part of the developer accommodating unit, the parallel part being parallel to and facing a part of the downward part of the conveying path.

2. The image-forming device according to claim 1, wherein the process cartridge further comprises:

a photosensitive unit including the upstream guide part and a photosensitive member configured to form a visible image thereon with the developer, the visible image being transferred onto the recording sheet; and a developing unit including the developer accommodating unit, the developing unit being detachably mounted in the photosensitive unit.

3. The image-forming device according to claim 1, further comprising a manual feeding path for conveying a recording sheet for manual feeding, wherein the manual feeding path is parallel to a line connecting the first end and the second end.

4. The image-forming device according to claim 2, further comprising a reversing path that reverses a recording sheet conveyed downstream of the photosensitive member to a position upstream of the pair of registration rollers in the conveying direction, wherein the reversing path meets the conveying path at the downward part.

5. The image-forming device according to claim 1, wherein the developer accommodating unit includes an upstream wall disposed at an upstream end region of the developer accommodating unit in the conveying direction, the upstream wall straightly extending from the upstream end part toward a direction away from the conveying path.

6. The image-forming device according to claim 1, wherein the pair of registration rollers is disposed downstream of the lowermost part in the conveying direction, wherein the concaved part is disposed upstream of the lowermost part in the conveying direction.

7. The image-forming device according to claim 5, wherein an imaginary line passing through both the upstream wall and the downward part intersects the concaved part.

8. The image-forming device according to claim 4, wherein the reversing path meets the conveying path at a meeting point of the downward part where the downward part coincides with the parallel part in the conveying direction.

* * * * *